US005298949A

United States Patent [19]

Yamamoto et al.

[11] Patent Number: 5,298,949

[45] Date of Patent: Mar. 29, 1994

[54] METHOD AND APPARATUS FOR REMOVING A PORTION OF A DEVELOPING MATERIAL DEPOSITED ON A NON-IMAGE AREA OF A SURFACE OF A LATENT IMAGE CARRIER

[75] Inventors: Hajime Yamamoto, Ibaraki; Hiroshi Terada, Ikoma, both of Japan

[73] Assignee: Matsushita Electric Industrial Co., Ltd., Osaka, Japan

[21] Appl. No.: 868,338

[22] Filed: Apr. 14, 1992

[30] Foreign Application Priority Data

| | | | |
|---|---|---|---|
| Apr. 16, 1991 | [JP] | Japan | 3-083905 |
| May 23, 1991 | [JP] | Japan | 3-118270 |
| May 23, 1991 | [JP] | Japan | 3-118274 |
| Jun. 3, 1991 | [JP] | Japan | 3-130928 |

[51] Int. Cl.[5] ..... G03G 13/00

[52] U.S. Cl. ..... 355/246; 118/657; 355/211; 355/261

[58] Field of Search ..... 355/210, 211, 261, 303, 355/301, 257, 253, 246; 118/657, 658, 637; 430/102

[56] References Cited

U.S. PATENT DOCUMENTS

| | | |
|---|---|---|
| 3,105,770 | 10/1963 | Lehmann et al. . |
| 3,866,574 | 2/1975 | Hardenrook et al. . |
| 3,989,007 | 11/1976 | Kompe et al. . |
| 4,395,476 | 7/1983 | Kanbe et al. . |
| 4,430,957 | 2/1984 | Cherbuy et al. . |
| 4,473,627 | 9/1984 | Kanabe et al. . |
| 4,913,088 | 4/1990 | Kanbe et al. . |
| 5,032,485 | 7/1991 | Kanbe et al. . |
| 5,044,310 | 9/1991 | Kanbe et al. . |

FOREIGN PATENT DOCUMENTS

| | | | |
|---|---|---|---|
| 0526137 | 2/1993 | European Pat. Off. . | |
| 1522670 | 10/1969 | Fed. Rep. of Germany . | |
| 0023986 | 2/1982 | Japan | 355/303 |
| 0029074 | 2/1982 | Japan | 355/303 |
| 58-9155 | 1/1983 | Japan . | |
| 58-16269 | 1/1983 | Japan . | |
| 60-117275 | 6/1985 | Japan . | |
| 60-117276 | 6/1985 | Japan . | |
| 61-3153 | 1/1986 | Japan . | |
| 63-42256 | 2/1988 | Japan . | |
| 0306485 | 12/1988 | Japan | 355/211 |
| 0239570 | 9/1989 | Japan | 355/211 |

OTHER PUBLICATIONS

"Electrophotographic Process", Hausle et al., IBM Technical Disclosure Bulletin, vol. 19, No. 4. Sep. 1976.

*Primary Examiner*—A. T. Grimley
*Assistant Examiner*—T. A. Dang
*Attorney, Agent, or Firm*—Wenderoth, Lind & Ponack

[57] ABSTRACT

An electrophotographic apparatus has a photoreceptor drum supported for rotation in one direction sequentially past a plurality of processing stations, a corona charger for electrostatically charging the photoreceptor drum, a developer hopper accommodating therein a mass of developing material used to form a visible toner image and a transfer charger for transferring the toner image onto a recording paper. The developer hopper has its bottom portion formed with an opening open so as to accommodate a portion of the photoreceptor drum, so that the developing material can be electrostatically deposited on the photoreceptor drum, including both non-image and image areas, to form a toner layer. The apparatus also includes an electrode member operable to electrostatically remove a portion of the toner layer covering the non-image area, thereby leaving the remaining portion of the toner layer in the image area to form the visible toner image.

13 Claims, 6 Drawing Sheets

METHOD AND APPARATUS FOR REMOVING A PORTION OF A DEVELOPING MATERIAL DEPOSITED ON A NON-IMAGE AREA OF A SURFACE OF A LATENT IMAGE CARRIER

BACKGROUND OF THE INVENTION

1. Field of the Invention

The present invention relates to an electrophotographic process and an electrophotographic apparatus which can be applicable in copying machines, printers and facsimile machines.

2. Description of the Prior Art

In the practice of the electrophotographic process, a magnetizable developing material, or a developer mix, of a two-component type has been widely utilized, comprising toner particles and carrier beads mixed together in a predetermined proportion. For developing an electrostatic latent image into a visible powder image with the use of the developer mix, various developing methods have hitherto been suggested. However, of them, a magnetic brush developing method developed in 1953 is currently widely utilized for document copying because, as compared with a cascade developing method, the magnetic brush developing method can result in a reduction in size of the apparatus and also in a satisfactory reproduction of fine line images.

Hereinafter, the conventional developing method utilizing the developer mix will be discussed in detail with reference to FIG. 12. FIG. 12 schematically illustrates a prior art electrophotographic apparatus. The illustrated apparatus generally comprises a hopper accommodating therein a mass of the developer mix 1 consisting of a mass of toner material and a mass of carrier. A developing sleeve 2 accommodates therein and is magnet roll 3 therein and positioned inside the hopper. A photoreceptor drum has a photosensitive layer 4 on its outer peripheral surface and is supported for rotation in one direction. A corona charger 5 for electrostatically charges the photosensitive layer 4. A transfer corona charger 7 transfers a visible powder image onto a recording medium such as, for example, a recording paper, and a cleaning unit 8 removes residue toner material from the photosensitive layer 4 on the photoreceptor drum.

The electrophotographic apparatus has a plurality of sequential processing stations. These include a charging station at which the corona charger 5 is disposed. An exposure station projects an imagewise light signal 6 onto the photosensitive layer 4 to form an electrostatic latent image thereon. A developing station develops the electrostatic latent image into the visible powder image by means of the developing sleeve 2. A transfer station at which the transfer corona charger 7 is disposed effects the transfer of the visible powder image onto the recording paper. A separating station separates the recording paper bearing the visible powder image from the photosensitive layer 4 for conveyance towards a fixing unit (not shown), and a cleaning station has the cleaning unit 8 disposed thereat. The photoreceptor drum having the photosensitive layer 4 is moved sequentially past these processing stations during one complete rotation thereof.

As is well known to those skilled in the art, during the rotation of the photoreceptor drum, the photosensitive layer 4 is electrostatically charged by the corona charger 5 at the charging station and is subsequently exposed at the exposure station to the imagewise light signal 6 to form thereon the electrostatic latent image which is developed at the next succeeding developing station into the visible powder image by means of magnetic brushes of the developer mix 1 formed on the developing sleeve 2. This visible powder image is then transferred at the transfer station onto the recording medium.

While during the continued rotation of the photoreceptor drum the recording paper bearing the visible powder image is separated from the photosensitive layer 4 and is thereafter transported towards the fixing unit for permanently fixing the image on the recording paper, residue toner material left on the photosensitive layer 4 is removed therefrom at the cleaning station in readiness for the next cycle of image formation.

The prior art electrophotographic apparatus of the construction described above has a number of problems. In the first place, the developing unit, including the hopper, the developing sleeve 2 and the magnet roll 3, is bulky and complicated, rendering the electrophotographic apparatus as a whole to be complicated and bulky. Also, the length of time during which the magnetic brushes of the developer mix 1 operatively contact the photosensitive layer 4 then moving past the developing station is so small as to eventually result in a poor image quality.

SUMMARY OF THE INVENTION

The present invention has been devised with a view to providing an electrophotographic process and an electrophotographic apparatus both of which are effective to provide high quality image reproduction with a simplified construction.

To this end, according to one aspect of the present invention, there is provided an electrophotographic process for an electrophotographic apparatus comprising a photoreceptor drum having a photosensitive layer on its outer peripheral surface and a magnet assembly enclosed therein and fixed in position inside the photoreceptor drum. A hopper accommodates therein a mass of magnetizable developing material. The method comprises the steps of electrostatically charging the photosensitive layer on the photoreceptor drum, projecting an imagewise light signal onto the photosensitive layer to form an electrostatic latent image, and magnetically depositing the magnetizable developing material on a portion of the photosensitive layer, which is situated within the hopper during a rotation of the photoreceptor drum in one direction, thereby developing the electrostatic latent image into a visible powder image.

According to another aspect of the present invention, there is provided an electrophotographic apparatus which comprises a rotatably supported photoreceptor drum having a photosensitive layer on its outer peripheral surface and enclosing therein a magnet assembly fixed in position. A hopper accommodates therein a mass of magnetizable developing material. A height regulating plate regulates the amount of developing material, and an electrode roll recovers the developing material wherein. After an electrostatic latent image is formed on the photosensitive layer by electrostatically charging the photosensitive layer and then exposing the photosensitive layer to an imagewise light signal, the developing material within the hopper is electrostatically attracted onto a portion of the photosensitive surface, which is situated within the hopper during a rotation of the photoreceptor drum in one direction, to deposit developing material thereon. During a continued rotation of the photoreceptor drum, that portion of the photosensitive layer is, after having passed the height regulating plate, brought to a position confronting the electrode roll. The developing material deposited on that portion of the photosensitive layer is thereby allowed to electrostatically move between the photosensitive layer and the electrode roll to leave a visible toner image on an image area of the photosensitive layer while the developing material deposited on a non-image area of the photosensitive layer is recovered by the electrode roll.

According to a further aspect of the present invention, there is provided an electrophotographic process for an electrophotographic apparatus comprising a photoreceptor drum having a photosensitive layer on its outer peripheral surface and a magnet assembly enclosed therein and fixed in position inside the photoreceptor drum. A hopper for accommodates therein a mass of magnetizable developing material silica particles added thereto, electrode roll recovers the developing material, and a height regulating plate regulates the amount of the developing material the method comprises the step of electrostatically charging the photosensitive layer on the photoreceptor drum, drum. An imagewise light signal is then projected onto the photosensitive layer to form an electrostatic latent image. The developing material is caused to be magnetically deposited on a portion of the photosensitive layer which is situated within the hopper during a rotation of the photoreceptor drum in one direction. The developing material deposited on the photosensitive layer is caused to move past the height regulating plate during a continued rotation of the photoreceptor drum to form a layer of the developing material thereon. The layer of the developing material on the photosensitive layer is further caused to confront the electrode roll, positioned at a location spaced from the photoreceptor drum a distance greater than the thickness of the layer of the developing material, causing the developing material forming the layer on the photosensitive layer to electrostatically move between the photosensitive layer to electrostatically move between the photosensitive layer and the electrode roll so as to leave a visible toner image on an image area of the photosensitive layer, while the developing material deposited on a non-image area of the photosensitive layer is recovered by the electrode roll.

According to a still further aspect of the present invention, there is provided an electrophotographic apparatus which comprises a rotatably supported photoreceptor drum having a photosensitive layer on its outer peripheral surface and enclosing therein a magnet assembly fixed in position. A hopper accommodates therein a mass of magnetizable developing material containing toner. A height regulating plate regulates the amount of developing material. An electrode roll recovers the developing material, and a high voltage power source applyies alternating current to the electrode roll. After an electrostatic latent image is formed on the photosensitive layer by electrostatically charging the photosensitive layer and then by exposing the photosensitive layer to an imagewise light signal, the developing material within the hopper is electrostatically attracted onto a portion of the photosensitive surface, which is situated within the hopper during a rotation of the photoreceptor drum in one direction, to deposit the developing material thereon. During a continued rotation of the photoreceptor drum, that portion of the photosensitive layer is, after having passed the height regulating plate to adjust the thickness of a layer of the developing material deposited on that portion of the photosensitive layer, brought to a position confronting the electrode roll. After an alternating electric field is applied between the photosensitive layer and the electrode roll, the developing material deposited on that portion of the photosensitive layer is recovered by the electrode roll.

Thus, unlike the prior art electrophotographic system, wherein the developing material is electrostatically deposited on the photosensitive layer on the photoreceptor drum in a pattern corresponding to the electrostatic latent image formed on such photosensitive layer, the basic idea of the present invention lies in that the toner material is electrostatically deposited on the entire portion of the photosensitive layer on the photoreceptor drum, which is successively brought inside the hopper during the rotation of the photoreceptor drum, so as to cover both the image area of the photosensitive layer occupied by the electrostatic latent image and a non-image area of the photosensitive layer. The portion of the toner material deposited on the non-image area of the photosensitive layer can be subsequently electrostatically removed from the photosensitive layer by the electrode roll, leaving the developing material covering the image area to form a visible powder image corresponding to the electrostatic latent image.

For this purpose, the magnet assembly is housed within the rotatably supported photoreceptor drum, and is fixed in position inside the photoreceptor drum so as to confront a bottom opening of the hopper at a location upstream of the electrode roll with respect to the direction of rotation of the photoreceptor drum. Thus, the present invention makes best use of the hollow inside the photoreceptor drum for accommodating the magnet assembly and, therefore, the developing unit can be so compact in size as to result in a reduction in size of the electrophotographic apparatus as a whole. Also, the area in which the development takes place, with the magnetizable developing material held in contact with the photosensitive layer, can be increased, and, therefore, a high quality image reproduction is possible.

BRIEF DESCRIPTION OF THE DRAWINGS

The above and other objects and features of the present invention are readily understood from the following description of preferred embodiments taken with reference to the accompanying drawings, in which.

DETAILED DESCRIPTION OF THE EMBODIMENTS

Figure 1:
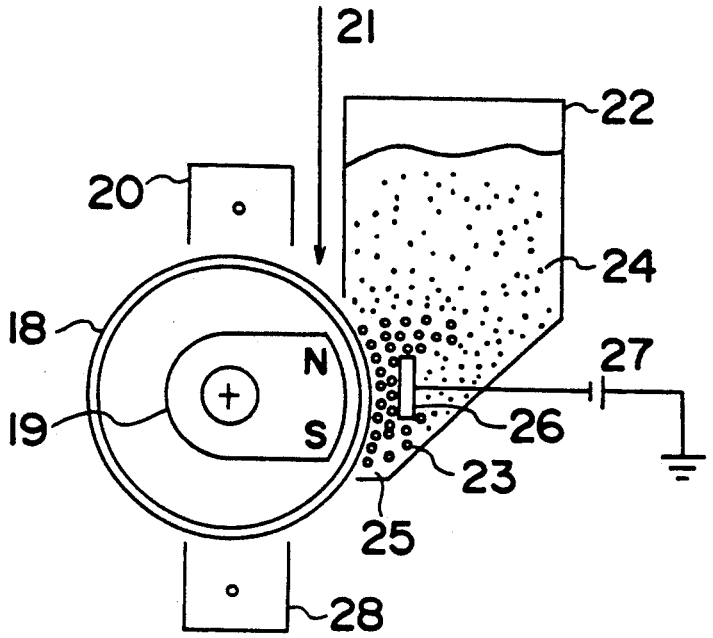
FIG. 1 is a schematic side view of an electrophotographic developing device according to a first preferred embodiment of the present invention.

In the present invention, use is made of a photoreceptor drum having an outer peripheral surface formed with a photosensitive layer and enclosing a magnet assembly within a hollow thereof. While the photoreceptor drum is supported for rotation in one direction past a plurality of processing stations, the magnet assembly is fixed in position inside the photoreceptor drum. If the magnet assembly and the photoreceptor drum are supported in coaxial relationship with each other, a drive mechanism for driving the photoreceptor drum can be advantageously simplified and the position of magnetic poles of the magnet assembly can readily be adjusted. The photosensitive layer which may be used in the practice of the present invention may be an organic photosensitive medium utilizing zinc oxide, selenium, cadmium sulfide, phthalocyanine or azo dye.

The developing material which may be used in the practice of the present invention may be a two-component type developer mix consisting of toner particles and carrier particles. The toner particles may be of a kind which can be prepared by dispersing a coloring dye such as carbon black or phthalocyanine into a binder resin such as, for example, styrene resin or acrylic resin, pulverizing the resultant mixture and classifying it. Alternatively, the toner particles may be of a powder which can be obtained by the use of either a spray drying method or a pearl polymerization process. In such a case, if the toner particles have silica particles deposited on their surfaces the toner material can exhibit an improved fluidity and, therefore, any possible appearance of background fogging on recording paper can be minimized.

The toner particles may be mixed directly with the carrier particles and, if desired, depending on the conditions in which it is used, the toner particles may have deposited on their surfaces a fine powder of fluorine resin, a finely divided plastics powder or zinc stearate. While the use of toner particles of not greater than 15 μm in average particle size is preferred, use of the toner particles of not greater than 12 μm in average particle size may result in a sharp image reproduction.

The carrier material which may be used in the practice of the present invention to form the developer mix together with the toner material may be a finely divided magnetizable powder of iron or ferrite or resin-coated particles of iron or ferrite, or may be a magnetizable powder which may be obtained by mixing a finely divided ferrite or magnetite powder dispersed in a quantity within the range of 30 to 80% into styrene resin, epoxy resin or styrene-acrylic resin, the resultant mixture being pulverized and classified. The use of carrier particles of not greater than 300 μm in average particle size is preferred. However, the use of carrier particles of not greater than 150 μm in average size may result in that the toner particles can be uniformly electrostatically charged.

Alternatively, the magnetizable developing material used in the practice of the present invention may comprise an insulated single component toner material. Where a one-component toner material is employed, the apparatus as a whole can be simplified in structure. The one-component toner material may be the material obtained by dispersing powdery magnetite or ferrite material into a binder resin such as styrene resin or acrylic resin together with a charge controlling agent, the resultant mixture being pulverized and classified. This toner material may be a powder obtained either by a spray drying method or chemically by a pearl polymerization method.

A developing method employed in the practice of the present invention is such that, after the entire photosensitive layer on the photoreceptor drum, including at least one image area, and a non-image area is deposited with the toner material, the portion of the toner material covering the non-image area of the photosensitive layer on the photoreceptor drum is subsequently removed by a recovery electrode roll. According to this developing method, if the toner material has a poor fluidity, the toner material deposited on the non-image area of the photosensitive layer sticks so stubbornly to the photosensitive layer that it will not easy to remove that portion of the toner material, eventually resulting in a background appearing on a recording medium. However, if the toner particles have their surfaces deposited with silica particles, the fluidity of the toner material can be improved, allowing the reduction in a non-electrostatic force of deposition on the photosensitive layer and, therefore, the eventual appearance of the background fog on the recording medium can be eliminated. It is, however, to be noted that the presence of the silica particles on the surfaces of the toner particles participates not only in an improvement in fluidity of the toner material as a whole, but also in an electrostatic charging of the toner particles. With this developing method, it has been found that, where the one-component toner material is utilized, no charging member for electrostatically charging the toner particles may not be utilized and that the addition of the silica particles to the toner particles is effective to allow charges to be shifted from the photosensitive layer to the toner particles when the latter are brought into contact with the photosensitive layer, with the consequence that the toner particles are charged to the same polarity as that of the photosensitive layer. The silica particles referred to above are generally referred to as colloidal silica. While the use of toner particles of not greater than 15 μm in average particle size is preferred, the use of the toner particles of not greater than 12 μm in average particle size can result in the recording medium bearing a sharp image.

In the practice of the present invention, use is made of a developer hopper having an opening open towards the photoreceptor drum to successively accommodate the photosensitive layer therein during a rotation of the photoreceptor drum in one direction. The developer material within the developer hopper is therefore held in contact with the photosensitive layer on the photoreceptor drum. Therefore, as the photosensitive layer on the photoreceptor drum moves inside the developer hopper, the developing material is deposited on the photosensitive layer by the effect of a magnetic force and is conveyed by the photosensitive layer during the rotation of the photoreceptor drum. Where the developing material employed at this time is the one-component toner material, the toner material can be kept on the photosensitive layer by the effect of both an electrostatic force of attraction and a so-called van der Waals force, even though the developing material deposited on the photosensitive layer moves out of a magnetic field.

The amount of the developing material deposited on the photosensitive layer can be adjusted by a developer height regulating plate. This height regulating plate may be made of an elastic material, such as natural or synthetic rubber. If the height regulating plate is in the form of a rubber plate made of polyurethane or silicone, and is held in direct contact with the photosensitive layer on the photoreceptor drum, a uniformly thin layer of the developing material can be formed on the photosensitive layer, that is, the outer peripheral surface of the photoreceptor drum.

Alternatively, the height regulating plate may be made of a magnetizable material, such as, for example, soft iron, nickel or magnetizable stainless steel (SUS 430). If at this time the height regulating plate is disposed at a position where it confronts and is spaced a distance from one of the opposite poles of the magnet enclosed by the photoreceptor drum, a magnetic force developed between the height regulating member and the magnet inside the photoreceptor drum serves to block the flow of a portion of the developing material, enabling a formation of a uniform layer of the developing material on the photosensitive layer.

Also, if the height regulating plate is made of an electroconductive material, and a direct current voltage is applied thereto during the use of the developing device of the present invention, the formation of the layer of the developing material on the photosensitive layer can further be facilitated. By way of example, if a direct current voltage of a value substantially equal to or higher than the surface potential of the photosensitive layer is applied to the electroconductive height regulating plate, the developing material can be forced to displace from the height regulating plate towards the photoreceptor drum, forming a uniformly thin and dense layer of the developing material on the photosensitive layer. Preferably, the height regulating plate, made of a magnetizable material, is spaced from the photosensitive layer a distance within the range of 100 μm to 4 mm. With this spacing, the thickness of the layer of the developing material so formed on the photosensitive layer ranges from 100 μm to 4 mm, and, particularly in the case of the one-component toner material, the formation of a layer of the developing material of about 50 μm has been found effective to obtain sharp line images on a recording medium. An electric power source from which electric power is applied to the height regulating plate may be a dedicated high voltage source. However, where the electrostatic charger for electrostatically charging the photosensitive layer is employed in the form of a Scorotron having a grid electrode, it can readily be accomplished by electrically connecting the grid electrode and the height regulating plate together.

The recovery a electrode roll for recovering portion of the developing material into the developer hopper is positioned adjacent to, but spaced a distance of 100 μm to 4 mm from, the photosensitive layer. If this distance between the recovery electrode roll and the photosensitive layer is chosen to be larger than the thickness of the layer of the developing material formed on the photosensitive layer, sharp line images can eventually be obtained. On the other hand, where a solid image of high density is desired, the distance between the photosensitive layer and the recovery electrode roll has to be chosen smaller than the thickness of the layer of the developing material on the photosensitive layer. That is, at this time, the outermost portion of the layer of the developing material on the photosensitive layer can contact the recovery electrode roll.

The recovery electrode roll may be made of any material, provided that it has an electroconductive property, and may be made of, for example, stainless steel or aluminum. The recovery electrode roll may have its outer surface polished or indented by the use of any known sandblasting technique. Also, it may be in the form of an electroconductive support member coated with an electroconductive resin formed by dispersing graphite into enamel. The selection of a particular material for the recovery electrode roll may be made in consideration of the fluidity of the developing material used. When in use, an alternating current voltage is applied to the recovery electrode roll. This alternating current voltage applied to the recovery electrode roll may have a frequency within the range of 50 to 5,000 Hz, preferably within the range of 30 to 3,000 Hz, although it may vary with the image forming process speed.

The alternating current voltage to be applied to the recovery electrode roll may preferably have a zero-to-peak value which is 0.5 to 3, more preferably 0.5 to 1.5, times the charge potential built up in the photosensitive layer. If a direct current voltage superimposed on the alternating current voltage is chosen to be of a value equal to or some 10% lower than the charge potential built up in the photosensitive layer, a favorable negative-positive reversed image can be obtained. In the case of normal development, it is nevertheless recommended to apply a voltage substantially equal to the charge potential in the photosensitive layer while toner material of reverse polarity is used. When this voltage is applied to the recovery electrode roll, the developing material deposited on the photosensitive layer of the photoreceptor drum can undergo motion between the photosensitive layer and the recovery electrode roll and the developing material deposited on the non-image area of the photosensitive layer will be eventually shifted towards the recovery electrode roll, leaving the developing material deposited on the image area of the photosensitive layer.

The recovery electrode roll is supported for rotation in one direction, which direction is preferably counter to the direction of rotation of the photoreceptor drum, so that the photosensitive layer on the photoreceptor drum can move in a direction conforming to the peripheral movement of the recovery electrode roll. The recovery electrode roll is preferably driven at a peripheral speed equal to the peripheral speed of the photoreceptor drum, that is, the speed of movement of the photoreceptor layer. By so doing, the appearance on the recording paper of an edge effect peculiar to electrophotography can be advantageously eliminated, and a uniformly developed solid image can be obtained. The use of a magnet inside the recovery electrode roll is advantageous in increasing the efficiency of recovery of the developing material from the photosensitive layer. The developing material deposited on the recovery electrode roll can be scraped off from the photoreceptor drum by a scraper disposed inside the hopper, and is recovered into the hopper for reuse, or may be discharged outside the developing device if so desired.

As described above, the developing material deposited on the recovery electrode roll is scraped off from the photoreceptor drum into the developer hopper by the scraper. The scraper used for this purpose is preferably electrically insulated to avoid any possible adverse influence it may bring on the recovery electrode roll. For this purpose, the scraper is preferably made of plastics, such as, for example, polyester film. Alternatively, the scraper may be in the form of a plate made of stainless steel or phosphor bronze and, in such a case, the scraper should be disposed in an electrically insulated relationship with the recovery electrode roll to avoid any possible adverse influence it may bring on the recovery electrode roll. The scraper and the height regulating plate referred to above may be integrated together and, in such case, the apparatus as a whole can be made compact in size.

Hereinafter, some preferred embodiments of the present invention will be described in detail with reference to the accompanying drawings.

Embodiment 1 (FIG. 1)

Referring to FIG. 1, the electrophotographic developing device shown therein comprises a photoreceptor drum 18 having its outer peripheral surface formed with an organic photosensitive layer formed by dispersing phthalocyanine into a binder resin a bipolar magnet 19 is disposed inside the photoreceptor drum 18 and mounted coaxially on a support shaft supporting the photoreceptor drum 18 a corona charger 20 charges the photosensitive layer of the photoreceptor drum 18 to a minus voltage a developer hopper 22 is disposed on a leading side of the corona charger 20 with respect to the direction of rotation of the photoreceptor drum, and accommodates therein a mass of developing material 25 containing a mixture of negative chargeable toner particles 24 with ferrous carrier particles 23 of 150 μm in average particle size. An electrode plate 26 is disposed inside the developer hopper 22; and is and is connected with a high voltage power source 27, from which a voltage can be applied to the electrode plate 26. Reference numeral 21 represents an imagewise light signal originating from a laser source and subsequently reflected from an image to be copied, which signal is projected onto the photosensitive layer on the photoreceptor drum to form an electrostatic latent image thereon in a pattern complemental to the image to be copied. Reference numeral 28 represents a transfer corona charger.

As shown therein, the developer hopper 22 has a bottom portion formed with an opening open towards the photoreceptor drum 18 so as to accommodate therein a portion of the photosensitive layer on the photoreceptor drum 18. In other words, the developer hopper 22 was so disposed as to allow that portion of the photosensitive layer to protrude thereinto as if it serves as a bottom for the developer hopper 22. Hence, the developing material 25 consisting of the toner particles 24 and the carrier particles 23 is magnetically disposed on the photosensitive layer during the rotation of the photoreceptor drum 18. The electrode plate 26, of 5 mm in width, was disposed spaced a distance of 2 mm from the photosensitive layer on the photoreceptor drum 18 and was applied with a voltage of −600 volts from the high voltage power source 27. The magnetic flux density as measured at the surface of the photosensitive layer on the photoreceptor drum 18 was 800 Gs. The photoreceptor drum 18 including the photosensitive layer has an outer diameter of 31 mm and was driven at a peripheral speed of 30 mm/sec.

The electrophotographic apparatus of the above described construction was operated in the following manner. The photosensitive layer on the photoreceptor drum 18 was charged to −700 volt by means of the corona charger 20, to which a voltage of −4 kV had been applied. Subsequently, the imagewise light signal was projected onto the charged photosensitive layer to form the electrostatic latent image. During the continued rotation of the photoreceptor drum 18 in one direction, the photosensitive layer bearing the electrostatic latent image was passed inside the developer hopper 22 and, as a result, the toner particles were deposited on the photosensitive layer in a pattern conforming to the electrostatic latent image to form a visible toner image thereon. The visible toner image formed on the photosensitive layer on the photoreceptor drum 18 was subsequently transferred by means of the transfer charger 28 onto a recording paper (not shown), which is then transported to a fixing unit (not shown) for permanently fixing the powder image on the recording paper in any known manner.

After the transfer of the powder image onto the recording paper, the photosensitive layer on the photoreceptor drum 18 was again electrostatically charged by the corona charger 20 in readiness for the next succeeding formation of an electrostatic latent image by exposure to the imagewise light signal 21.

As a result, the recording paper obtained has showed that sharp line images were obtained with no toner scattering observed and, at the same time, as a meritorious effect brought about by the use of the counter electrode plate, copied images having a solid portion of 1.5 in density could be obtained.

It is to be noted that, although in the practice of the foregoing embodiment of the present invention a direct current voltage was used for the voltage from the electric power source, an alternating current voltage may be applied.

Figure 2:
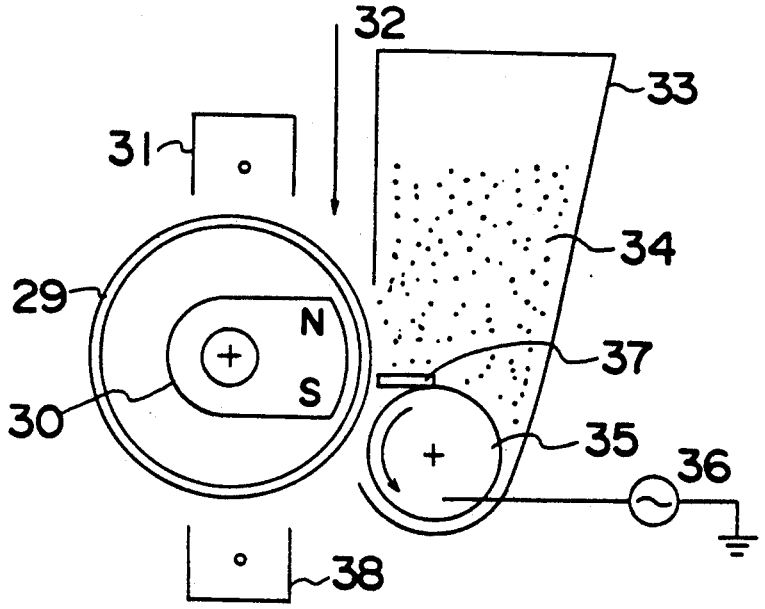
FIGS. 2 to 6 are views similar to FIG. 1, showing the electrophotographic developing device according to second to sixth preferred embodiments of the present invention.

Embodiment 2 (FIG. 2)

The electrophotographic apparatus according to a second preferred embodiment of the present invention is shown in FIG. 2. In the practice of this embodiment, one component toner material was employed, which was prepared by mixing and kneading a metal complex of oxycarbonate (3%) with magnetizable magnetite (40%), pulverizing the resultant mixture and classifying the pulverized mixture to give toner particles of 12 μm in average particle size (1.3 in density). This one component toner material was charged to a negative voltage when brought into contact with the developer hopper and the photosensitive layer on the photoreceptor drum.

Referring now to FIG. 2, reference numeral 29 represents a photoreceptor drum having its outer peripheral surface formed with a photosensitive layer prepared by dispersing phthalocyanine into a binder resin; resin reference numeral 30 represents a bipolar magnet disposed inside the photoreceptor drum 29, and is fixed coaxially on a shaft for the support of the photoreceptor drum 29. Reference numeral 31 represents a corona charger operable to electrostatically charge the photosensitive layer to a negative voltage, and reference numeral 32 represents an imagewise light signal originating from a laser source and subsequently reflected from an image to be copied, which signal is projected onto the photosensitive layer on the photoreceptor drum 29 to form an electrostatic latent image thereon in a pattern complementary to the image to be copied. Reference numeral 33 represents a developer hopper. Reference numeral 34 represents the negative chargeable one component toner material. Reference numeral 35 represents a counter electrode roll disposed at a position spaced a distance of 240 μm from the photosensitive layer on the photoreceptor drum 29, and reference numeral 36 represents a high voltage power source from which a voltage is applied to the electrode roll 35.

Reference numeral 37 represents a height regulating plate made of soft iron and having one of its opposite side edges spaced 240 μm from the photosensitive layer and the other of the opposite side edges held in contact with the electrode roll. This height regulating plate 37 serves not only to adjust the amount of the toner material deposited on the photosensitive layer during the rotation of the photoreceptor drum 29, but also to scrape the developing material sticking to the electrode roll 35 off of the electrode roll 35. Reference numeral 38 represents a transfer corona charger. The magnetic flux density at the photosensitive layer on the photoreceptor drum 29 is 800 Gs. The photoreceptor drum 29 including the photosensitive layer has an outer diameter of 31 mm and was driven at a peripheral speed of 30 mm/sec.

The photosensitive layer on the photoreceptor drum 29 was charged to −700 volts by means of the corona charger 31, to which a voltage of −4 kV had been applied. Subsequently, the imagewise light signal 32 was projected onto the charged photosensitive layer to form the electrostatic latent image. The one component toner material 34 was subsequently deposited on the photosensitive layer within the developer hopper 33 and, as it passes by the height regulating plate 37, the layer of the toner material on the photosensitive layer was adjusted to a thickness of about 30 μm. While the electrode roll 35 was provided with a direct current voltage of −650 volts from the high voltage power source 36, which had been superimposed with an alternating current bias of 1 kVo-p in voltage and of 1 kHz in frequency, the photosensitive layer 29 on the photoreceptor drum 29 was passed in front of the electrode roll 35 during the continued rotation of the latter.

The toner material underwent a reciprocating motion between the photosensitive layer and the electrode roll 35, eventually leaving the toner material deposited on the electrostatic latent image on the photosensitive layer while the residue toner material was transferred onto the developing roll 35. The visible toner image so formed on the photosensitive layer on the photoreceptor drum 29 was then transferred by the transfer charger 38 onto a recording paper (not shown), which was subsequently transported through a fixing unit (not shown) to permanently fix the powder image on the recording paper in any known manner.

After the transfer of the powder image onto the recording paper, the photosensitive layer on the photoreceptor drum 29 was again electrostatically charged by the corona charger 20 in readiness for the next succeeding formation of an electrostatic latent image by exposure to the imagewise light signal 32.

As a result, the recording paper obtained has showed that sharp line images were obtained with no toner scattering observed and, at the same time, as a meritorious effect brought about by the use of the counter electrode plate, copied images having a solid portion of 1.5 in density could be obtained. Also, due to the application of the alternating current voltage to the electrode roll, the image obtained on the recording paper was found free from any background fogging.

Figure 3:
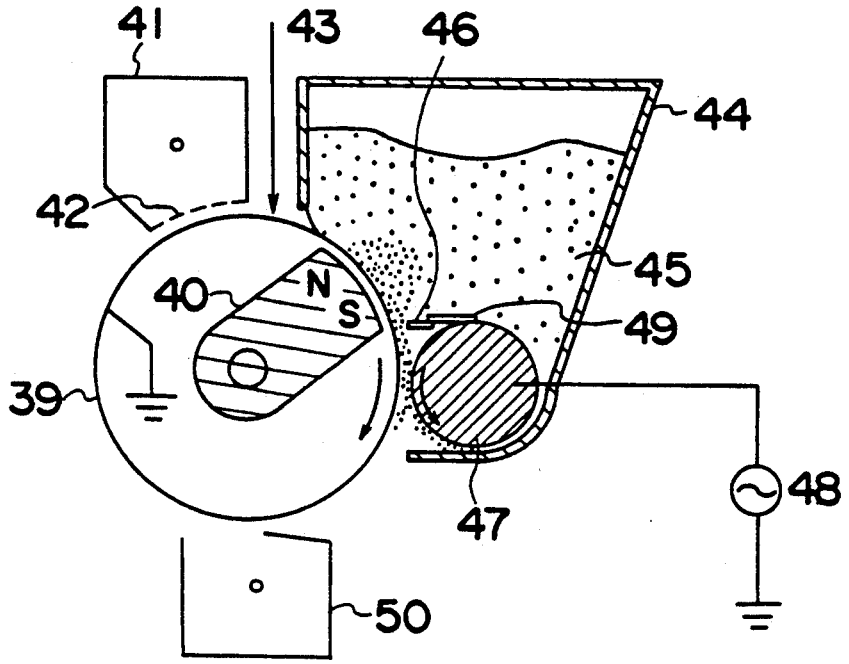

Embodiment 3 (FIG. 3)

The electrophotographic apparatus according to a third preferred embodiment of the present invention is shown in FIG. 3.

Referring now to FIG. 3, reference numeral 39 represents a photoreceptor drum having its outer peripheral surface formed with a photosensitive layer prepared by dispersing phthalocyanine into a binder resin. Reference numeral 40 represents a bipolar magnet disposed inside the photoreceptor drum 39 and fixed coaxially on a shaft supporting the photoreceptor drum 39. Reference numeral 41 represents a corona charger operable to electrostatically charge the photosensitive layer to a negative voltage. Reference numeral 42 represents a grid electrode for controlling the potential to which the photosensitive layer is charged, and reference numeral 43 represents an imagewise light signal originating from a laser source and subsequently reflected from an image to be copied. The signal is projected onto the photosensitive layer on the photoreceptor drum 39 to form an electrostatic latent image thereon in a pattern complementary to the image to be copied. Reference numeral 44 represents a developer hopper. Reference numeral 45 represents the negative chargeable and magnetizable one component toner material of 12 μm in average particle size. Reference numeral 46 represents a height regulating plate made of soft iron. Reference numeral 47 represents a toner recovery electrode roll made of aluminum; and reference numeral 48 represents a high voltage power source from which an alternating current voltage is applied to the electrode roll 47.

Reference numeral 49 represents a scraper in the form of a polyester film used to scrape toner material deposited on the recovery electrode roll 47, and reference numeral 50 represents a transfer corona charger. The magnetic flux density at the photosensitive layer on the photoreceptor drum 39 is 800 Gs. The photoreceptor drum 39 including the photosensitive layer has an outer diameter of 31 mm and was driven at a peripheral speed of 30 mm/sec.

The photosensitive layer on the photoreceptor drum 39 was charged to −500 volts by means of the corona charger 41, to which a voltage of −4 kV had been applied, while a voltage of −500 volts was applied to the grid 42. Subsequently, the imagewise light signal 43 was projected onto the charged photosensitive layer to form the electrostatic latent image. The magnetizable one component toner material 45 was subsequently magnetically deposited on the photosensitive layer within the developer hopper 44 and, as it passed by the height regulating plate 46 to which a voltage of −500 volt was applied, the layer of the toner material was formed in a thickness of about 50 μm on the photosensitive layer on the photoreceptor drum 39. At this time, the toner material was charged to about −3 μC/g. During the continued rotation of the photoreceptor drum 39, the toner layer on the photosensitive layer was allowed to pass in front of the recovery electrode roll 47 to which an alternating current voltage of 700 VO-p having a frequency of 1 kHz which was superimposed with a direct current voltage of −450 volt was applied from the high voltage power source 48. As a result, the toner material forming the toner layer on the photosensitive layer underwent a reciprocating motion between the photosensitive layer and the recovery electrode roll 47, eventually leaving the toner material deposited on the electrostatic latent image, on the photosensitive layer to form a visible toner image while the residue toner material was transferred onto the recovery electrode roll 47. The toner material deposited on the recovery electrode roll 47 was subsequently scraped by the scraper 49 off of the photoreceptor drum 39 and was recovered to the developer hopper 44 for reuse.

The visible toner image formed on the photosensitive layer on the photoreceptor drum 39 in the manner described above was then transferred by the transfer charger 50 onto a recording paper (not shown) which was subsequently transported through a fixing unit (not shown) to permanently fix the powder image on the recording paper in any known manner. After the transfer of the powder image onto the recording paper, the photosensitive layer on the photoreceptor drum 29 was again electrostatically charged by the corona charger 20 in readiness for the next succeeding formation of an electrostatic latent image by exposure to the imagewise light signal 43. As a result, sharp images with no toner scattering could be obtained.

Figure 4:
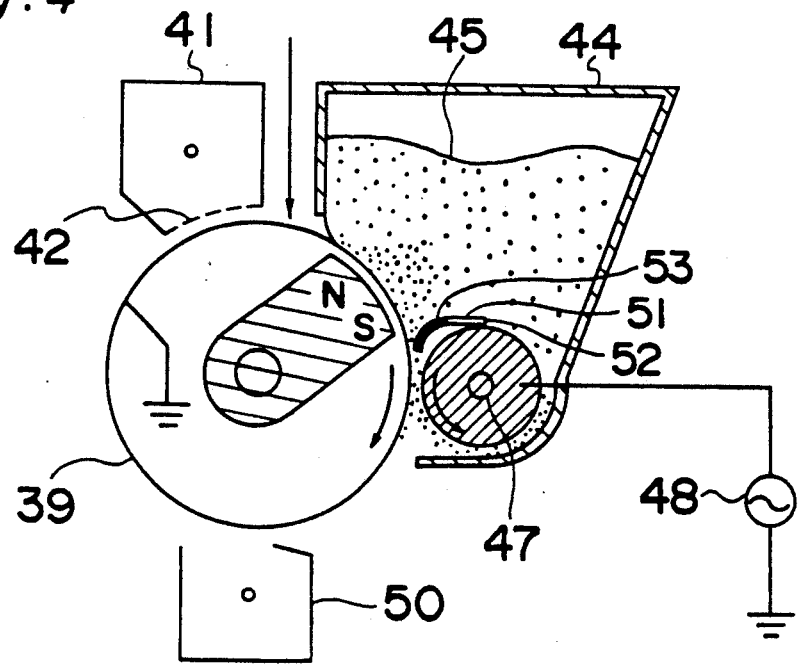

Embodiment 4 (FIG. 4)

The electrophotographic apparatus according to a fourth embodiment of the present invention is shown in FIG. 4, which is substantially similar to that shown in FIG. 3 except for the details of the height regulating plate. The height regulating plate employed in the practice of the fourth embodiment of the present invention is generally identified by 51, and was in the form of an elastic blade 53 of 1 mm in thickness made of polyurethane and bonded to a polyester support member 52. The height regulating plate 51 in the form of the elastic blade was held in light contact with the photosensitive layer on the photoreceptor drum so that the toner layer deposited thereon could be regulated to a thickness of 30 μm.

When the electrophotographic apparatus of FIG. 4 was operated under the same conditions as in Embodiment 3, sharp images with no toner scattering could be obtained.

Figure 5:
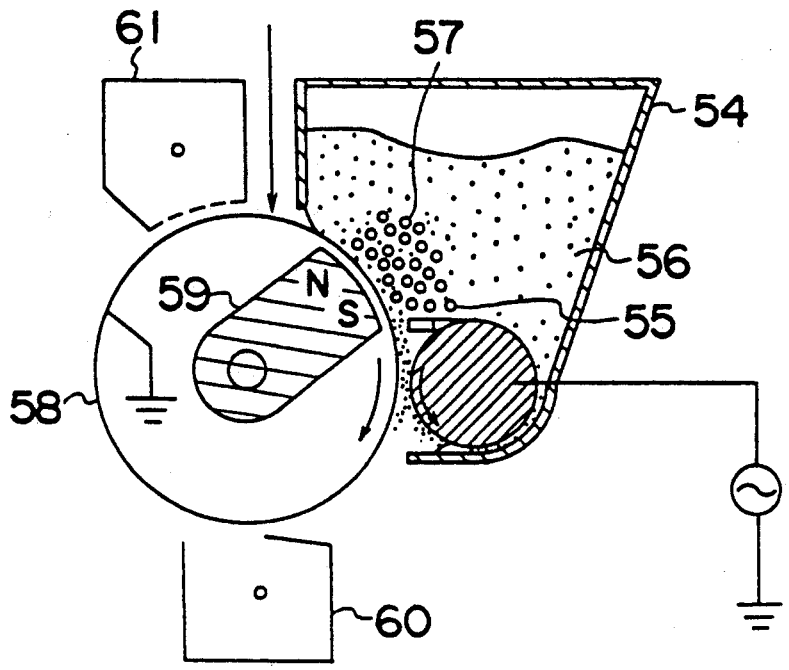

Embodiment 5 (FIG. 5)

The electrophotographic apparatus according to a fifth embodiment of the present invention is shown in FIG. 5, which is substantially similar to that shown in FIG. 3 except that, according to the fifth embodiment, the developing material was employed in the form of a two-component developer mix 57 consisting of a mass of toner particles 56 colored with carbon black and a mass of silicone coated iron carrier particles 55 of 100 μm in average particle size. A mass of the developer mix 57 was filled in a developer hopper 54 and was allowed to deposit magnetically on the photosensitive layer formed on the photoreceptor drum 58. When the photosensitive layer carrying the electrostatic latent image is passed through the developer mix 57, the developer mix 57 did not move by being magnetically attracted by the magnet 59, but only the toner material 56 moved together with the photosensitive layer on the photoreceptor drum 58 during the rotation of the latter, forming a toner layer of about 30 μm in thickness on the photosensitive layer.

Thereafter, in a manner similar to that described in connection with the third embodiment of the present invention, through a process of developing the electrostatic latent image by the action of the recovery electrode roll 59, a visible toner image was obtained on the photosensitive layer on the photoreceptor drum 58. After the transfer of the visible toner image onto a recording paper by means of the transfer charger 60, the recording paper was transported through the fixing unit (not shown) to permanently fix the toner image on the recording paper. On the other hand, after the transfer, the photosensitive layer on the photoreceptor drum 58 was again electrostatically charged by the corona charger 61 in readiness for the next succeeding formation of an electrostatic latent image by exposure to the imagewise light signal.

The resultant recording paper has shown sharp images reproduced thereon with no toner scattering.

Figure 6:
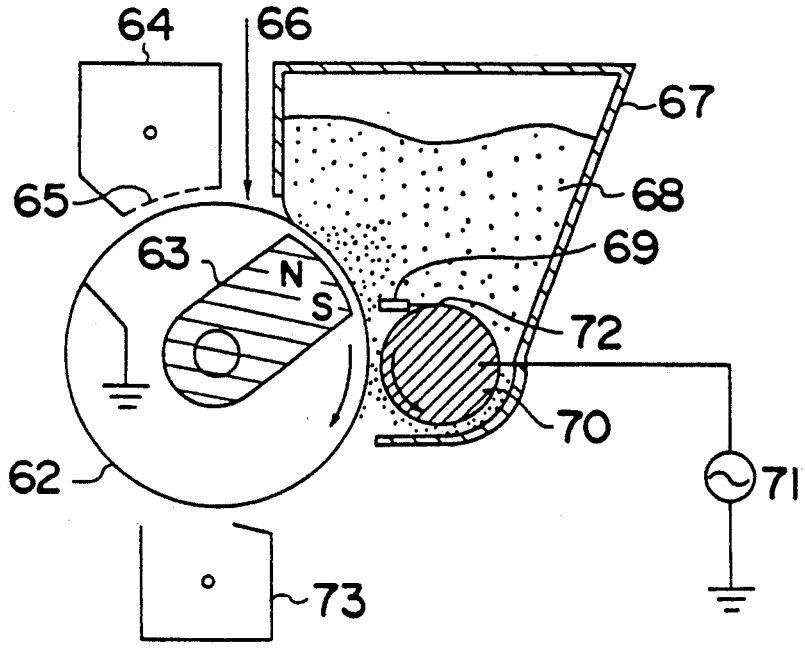
Figure 7:
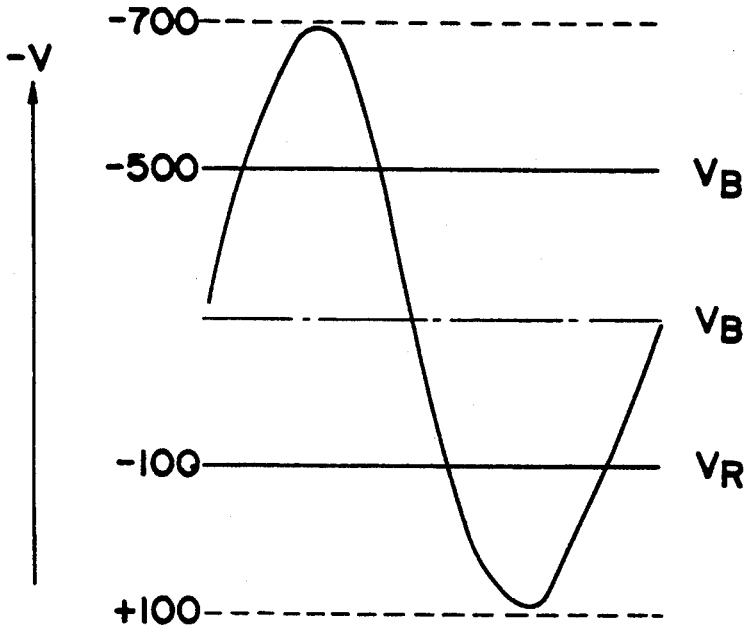
FIG. 7 is a diagram showing a waveform of an alternating current voltage applied in the developing device of the sixth embodiment of the present invention.

Embodiment 6 (FIGS. 6 and 7)

The electrophotographic apparatus according to a sixth embodiment of the present invention is shown in and described with reference to FIGS. 6 and 7.

In FIG. 6, reference numeral 62 represents a photoreceptor drum having its outer peripheral surface formed with a photosensitive layer prepared by dispersing phthalocyanine into a polyester binder resin. Reference numeral 63 represents a bipolar magnet fixedly mounted coaxially on a support shaft for the support of the photoreceptor drum 62. Reference numeral 64 represents a corona charger for charging the photosensitive layer to a negative voltage. Reference numeral 65 represents a grid electrode for controlling the potential charged on the photosensitive layer. Reference numeral 66 represents an imagewise light signal. Reference numeral 67 represents a developer hopper. Reference numeral 68 represents a negative chargeable magnetizable one, component toner material of 10 μm in average particle size, and reference numeral 69 represents a height regulating plate made of a magnetizable material such as nickel, which plate 69 is electrically connected with the grid electrode 65 of the corona charger 64.

Reference numeral 70 represents a recovery electrode roll made of aluminum. Reference numeral 71 represents an alternating current voltage source from which a voltage is applied to the recovery electrode roll 70. Reference numeral 72 represents a scraper employed in the form of a polyester film for scraping the developing material off from the photosensitive layer, and reference numeral 73 represents a transfer corona charger for transferring a visible toner image on the photosensitive layer onto a recording paper. The magnetic flux density at the photosensitive layer on the photoreceptor drum 62 is 800 Gs. The photoreceptor drum 62 including the photosensitive layer has an outer diameter of 30 mm and was driven at a peripheral speed of 30 mm/sec.

In the practice of this embodiment, a magnetizable one component toner material was employed which comprises 70 wt % of polyester resin, 25 wt % of ferrite, 3 wt % of carbon black and 2 wt % of a metal complex of oxycarbonate, and is further provided with 0.4 wt % of colloidal silica.

The photosensitive layer on the photoreceptor drum 62 was charged by the corona charger 64 to −500 volts by the application of a voltage of −4 kV to the corona charger 64 and a voltage of −500 volts to the grid electrode 65. Subsequently, the imagewise light signal 66 originating from a laser source and reflected from an image to be copied was projected onto the charged photosensitive layer to form the electrostatic latent image. At this time, a portion of the photosensitive layer exposed to the imagewise light signal 66 was charged to −100 volt. The magnetizable one component toner material 68 was subsequently magnetically deposited on the photosensitive layer within the developer hopper 67 and, as it passed by the height regulating plate 69, spaced a distance of 240 μm from the photosensitive layer, and to which a voltage of −500 volt was applied, a toner layer was formed in a thickness of about 80 μm on the photosensitive layer on the photoreceptor drum 62. At this time, the toner material was charged to about −3 μC/g.

During the continued rotation of the photoreceptor drum 62, the toner layer on the photosensitive layer was allowed to pass in front of the recovery electrode roll 70, to which an alternating current voltage of 400 VO-p having a peak-to-peak value of 800 volt and having a frequency of 300 Hz and which was superimposed with a direct current voltage of −300 volt was applied from the high voltage power source 71. The waveform of the applied alternating current voltage applied to the recovery electrode roll 70 is shown in FIG. 7. As a result, the toner material forming the toner layer on the photosensitive layer underwent a reciprocating motion between the photosensitive layer and the recovery electrode roll 70, eventually leaving the toner material deposited on the electrostatic latent image on the photosensitive layer to form a visible toner image while the residue toner material was transferred onto the recovery electrode roll 70. The toner material deposited on the recovery electrode roll 70 was subsequently scraped by the scraper 72 off of the photoreceptor drum 62 and was recovered in the developer hopper 67 for reuse.

The visible toner image formed on the photosensitive layer on the photoreceptor drum 62 in the manner described above was then transferred by the transfer charger 73 onto a recording paper (not shown), which was subsequently transported through a fixing unit (not shown) to permanently fix the powder image on the recording paper in any known manner. After the transfer of the powder image onto the recording paper, the photosensitive layer on the photoreceptor drum 62 was again electrostatically charged by the corona charger 20 in readiness for the next succeeding formation of an electrostatic latent image by exposure to the imagewise light signal 66. As a result, sharp images with no toner scattering could be obtained.

Figure 8:
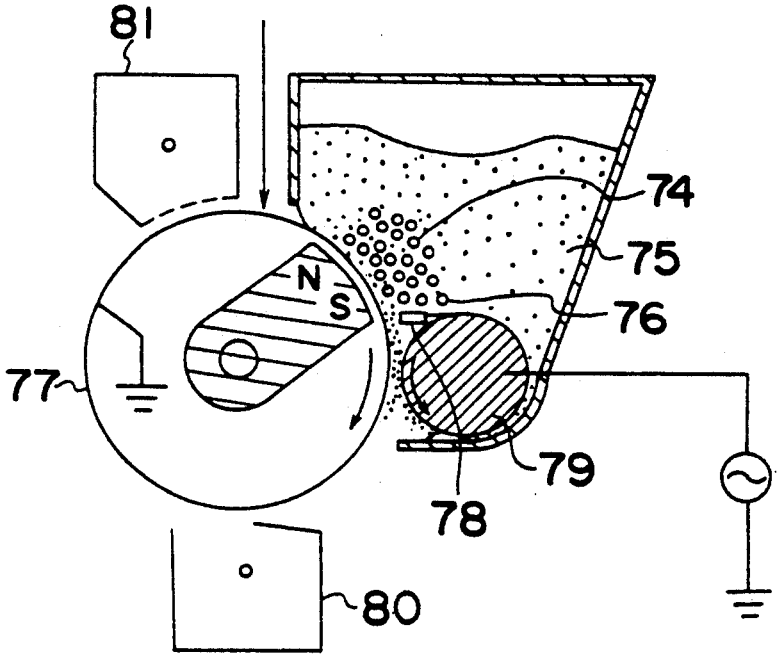
FIGS. 8 to 11 are views similar to FIG. 1, showing the electrophotographic developing device according to seventh to tenth preferred embodiments of the present invention.

Embodiment 7 (FIG. 8)

A seventh preferred embodiment of the present invention will now be described with reference to FIG. 8. The electrophotographic apparatus according to this embodiment is similar to that shown in and described with reference to FIG. 6, but in place of the magnetizable one component toner material used in the sixth embodiment, a two component developing material 76 consisting of toner 75 and carrier 74 was used for the developing material in the practice of this embodiment. The toner material contained in this two-component toner material comprises styrene-acrylic resin, 5 wt % of carbon black and 2 wt % of a metal complex of oxycarbonate and is added with 0.1 wt % of colloidal silica. The two-component developing material 76 consisting of the toner material 75 and the carrier material comprising silicone-coated powdery ferrite carrier particles 74 of 100 μm in average particle size was provided in the developer hopper 67 and was allowed to deposit magnetically on the photosensitive layer formed on the photoreceptor drum 77. When the photosensitive layer carrying the electrostatic latent image is passed through the developing material 76, the developing material 76 did not move by being magnetically attracted by the magnet 63, but only the toner material 75 moved together with the photosensitive layer on the photoreceptor drum 77 during the rotation of the latter, forming a toner layer of about 30 μm in thickness on the photosensitive layer as it was moved past the height regulating plate 78.

Thereafter, in a manner similar to that described in connection with the sixth embodiment of the present invention, through a process of developing the electrostatic latent image by the action of the recovery electrode roll 79, a visible toner image was obtained on the photosensitive layer on the photoreceptor drum 77. After the transfer of the visible toner image onto a recording paper by means of the transfer charger 80, the recording paper was transported through the fixing unit (not shown) to permanently fix the toner image on the recording paper. On the other hand, after the transfer, the photosensitive layer on the photoreceptor drum 77 was again electrostatically charged by the corona charger 81 in readiness for the next succeeding formation of an electrostatic latent image by exposure to the imagewise light signal.

The resultant recording paper has shown sharp images reproduced thereon with no toner scattering.

Figure 9:
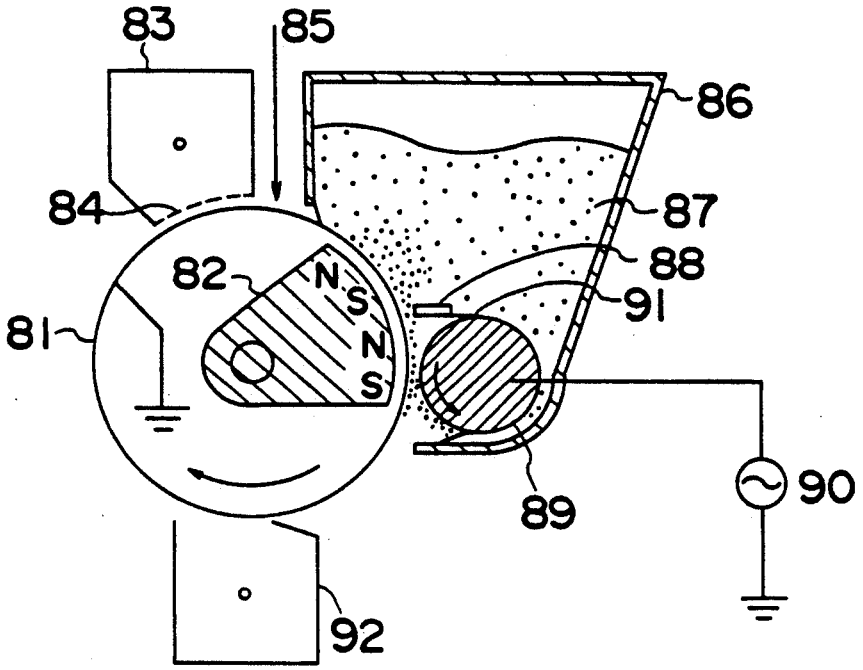

Embodiment 8 (FIG. 9)

The electrophotographic apparatus used in the practice of an eighth embodiment of the present invention is shown in FIG. 9. In FIG. 8, reference numeral 81 represents a photoreceptor drum having its outer peripheral surface formed with a photosensitive layer prepared by dispersing phthalocyanine into a polyester binder resin. Reference numeral 82 represents a four-pole magnet fixedly mounted coaxially on a shaft for the support of the photoreceptor drum 81. Reference numeral 83 represents a corona charger for charging the photosensitive layer to a negative voltage. Reference numeral 84 represents a grid electrode for controlling the potential charged on the photosensitive layer. Reference numeral 85 represents an imagewise light signal. Reference numeral 86 represents a developer hopper. Reference numeral 87 represents a negative chargeable and magnetizable one component toner material of about 10 μm in average particle size. Reference numeral 88 represents a height regulating plate made of non-magnetizable stainless steel. Reference numeral 89 represents a recovery electrode roll made of aluminum. Reference numeral 90 represents an alternating current voltage source from which a voltage is applied to the recovery electrode roll. Reference numeral 91 represents a scraper in the form of a polyester film for scraping the toner material off of the recovery electrode roll 89, and reference numeral 92 represents a transfer corona charger for transferring a visible toner image onto a recording paper.

The magnetic flux density at the photosensitive layer on the photoreceptor drum 92 is 1.000 Gs. The photoreceptor drum 81 including the photosensitive layer has an outer diameter of 30 mm and was driven at a peripheral speed of 30 mm/sec. The one component toner material used is of a composition containing 61 wt % of polyester resin, 37 wt % of magnetite and 2 wt % of a metal complex of oxycarbonate, and further provided with 1.0 wt % of colloidal silica.

The photosensitive layer on the photoreceptor drum 81 was charged to −500 volts by means of the corona charger 83 by the application of a voltage of −4 kV to the corona charger 83 and a voltage of −500 volts to the grid 84. Subsequently, the imagewise light signal 85 was projected onto the charged photosensitive layer to form the electrostatic latent image. At this time, a portion of the photosensitive layer on the photoreceptor drum 81 was charged to −100 volts. The magnetizable one component toner material 87 was subsequently magnetically deposited on the photosensitive layer within the developer hopper 84 and was moved past the height regulating plate 88, spaced a distance of 150 μm from the photosensitive layer and to which a voltage of −500 volts was applied, forming a toner layer of about 200 μm on the photosensitive layer on the photoreceptor drum 81. At this time, the toner material was charged to about −5 μC/g.

During the continued rotation of the photoreceptor drum 81, the toner layer on the photosensitive layer was allowed to pass in front of the recovery electrode roll 47, which was spaced a distance of 150 μm from the photosensitive layer on the photoreceptor drum 81. An alternating current voltage of 450 VO-p having a peak-to-peak value of 900 volts and having a frequency of 600 Hz, which was superimposed with a direct current voltage of −400 volts, was applied to the recovery electrode roll 89 from the high voltage power source 90. As a result, the toner material forming the toner layer on the photosensitive layer underwent a reciprocating motion between the photosensitive layer and the recovery electrode roll 89, eventually leaving the toner material deposited on the electrostatic latent image on the photosensitive layer to form a visible toner image while the residue toner material was transferred onto the recovery electrode roll 89. The toner material deposited on the recovery electrode roll 89 is subsequently scraped by the scraper 91 off of the photoreceptor drum 81 and was recovered in the developer hopper 86 for reuse.

The visible toner image formed on the photosensitive layer on the photoreceptor drum 81 in the manner described above was then transferred by the transfer charger 92 onto a recording paper (not shown) which was subsequently transported through a fixing unit (not shown) to permanently fix the powder image on the recording paper in any known manner.

After the transfer of the powder image onto the recording paper, the photosensitive layer on the photoreceptor drum 81 was again electrostatically charged by the corona charger 83 in readiness for the next succeeding formation of an electrostatic latent image by exposure to the imagewise light signal 85. As a result, dense images having a solid image portion of 1.7 in reflective density could be obtained.

Figure 10:
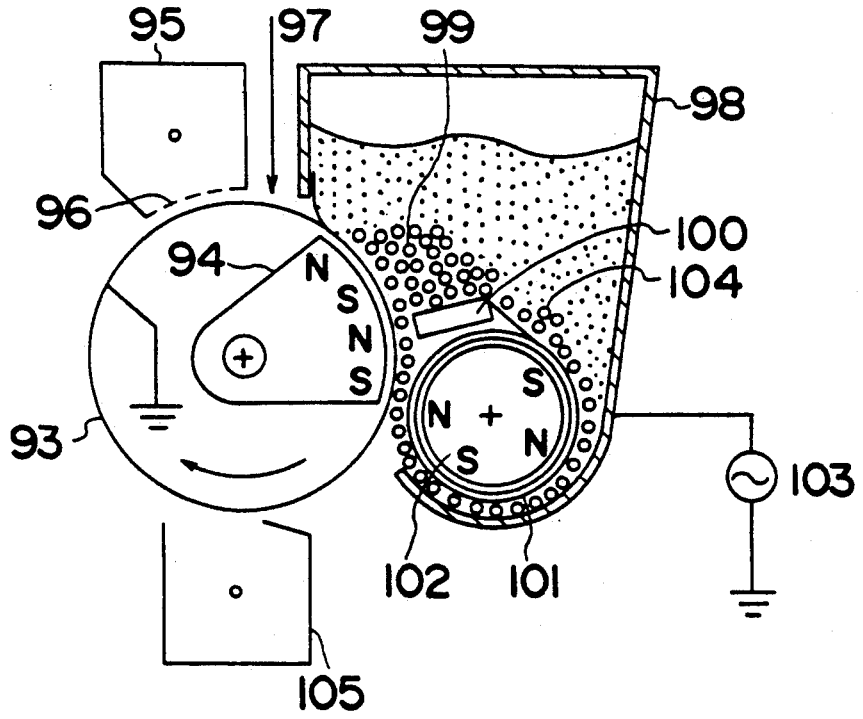

Embodiment 9 (FIG. 10)

The electrophotographic apparatus according to a ninth embodiment of the present invention is shown in and described with reference to FIG. 10.

In FIG. 10, reference numeral 93 represents a photoreceptor drum having its outer peripheral surface formed with a photosensitive layer prepared by dispersing phthalocyanine into a polyester binder resin; reference numeral 94 represents a four-pole magnet fixedly mounted coaxially on a support shaft for the support of the photoreceptor drum 93. Reference numeral 95 represents a corona charger for charging the photosensitive layer to a negative voltage Reference numeral 96 represents a grid electrode for controlling the potential charged on the photosensitive layer. Reference numeral 97 represents an imagewise light signal. Reference numeral 98 represents a developer hopper. Reference numeral 99 represents a negative exchargeable magnetizable one component toner material of 10 μm in average particle size, and reference numeral 100 represents a height regulating plate made of stainless steel.

Reference numeral 101 represents a recovery electrode roll made of aluminum. Reference numeral 102 represents a four-pole magnet fixedly mounted coaxially on a support shaft for the support of the recovery electrode roll 101. Reference numeral 103 represents an alternating current voltage source from which a voltage is applied to the recovery electrode roll 101. Reference numeral 104 represents a scraper employed in the form of a polyester film for scraping the developing material off of the photosensitive layer, and reference numeral 105 represents a transfer corona charger for transferring a visible toner image on the photosensitive layer onto a recording paper. The magnetic flux density at the photosensitive layer on the photoreceptor drum 93, and also at an outer peripheral surface of the recovery electrode roll 101, is 800 Gs. The photoreceptor drum 93 including the photosensitive layer has an outer diameter of 30 mm and was driven at a peripheral speed of 30 mm/sec.

The photosensitive layer on the photoreceptor drum 93 was charged by the corona charger 95 to −500 volts by the application of a voltage of −4 kV to the corona charger 95 and a voltage of −500 volts to the grid electrode 96. Subsequently, the imagewise light signal 97 originating from a laser source and reflected from an image to be copied was projected onto the charged photosensitive layer to form the electrostatic latent image. The magnetizable one component toner material 99 was subsequently magnetically deposited on the photosensitive layer within the developer hopper 98 and, as it passed by the height regulating plate 100, to which a voltage of −500 volt was applied, a toner layer of about 150 μm in thickness was formed on the photosensitive layer on the photoreceptor drum 93. At this time, the toner material was charged to about −3 μC/g.

During the continued rotation of the photoreceptor drum 93, the toner layer on the photosensitive layer was allowed to pass in front of the recovery electrode roll 101. At this time, the recovery electrode roll 101 was spaced a distance of 200 μm from the photosensitive layer and was applied from the high voltage power source 103 with an alternating current voltage of 700 VO-p having a frequency of 1 kHz, which was superimposed with a direct current voltage of −450 volts. As a result, the toner material forming the toner layer on the photosensitive layer underwent a reciprocating motion between the photosensitive layer and the recovery electrode roll 101, eventually leaving the toner material deposited on the electrostatic latent image on the photosensitive layer to form a visible toner image, while the residue toner material was transferred onto the recovery electrode roll 101. The toner material transferred onto the recovery electrode roll 101 was retained thereon by the magnetism of the magnet 102 disposed inside the recovery electrode roll 101, and was then conveyed during the rotation thereof towards a position where it was subsequently scraped by the scraper 104 off of the photoreceptor drum 93 and was recovered in the developer hopper 98 for reuse.

The visible toner image formed on the photosensitive layer on the photoreceptor drum 93 in the manner described above was then transferred by the transfer charger 105 onto a recording paper (not shown), which was subsequently transported through a fixing unit (not shown) to permanently fix the powder image on the recording paper in any known manner. After the transfer of the powder image onto the recording paper, the photosensitive layer on the photoreceptor drum 93 was again electrostatically charged by the corona charger 95 in readiness for the next succeeding formation of an electrostatic latent image by exposure to the imagewise light signal 97. As a result, sharp images with no toner scattering could be obtained.

Figure 11:
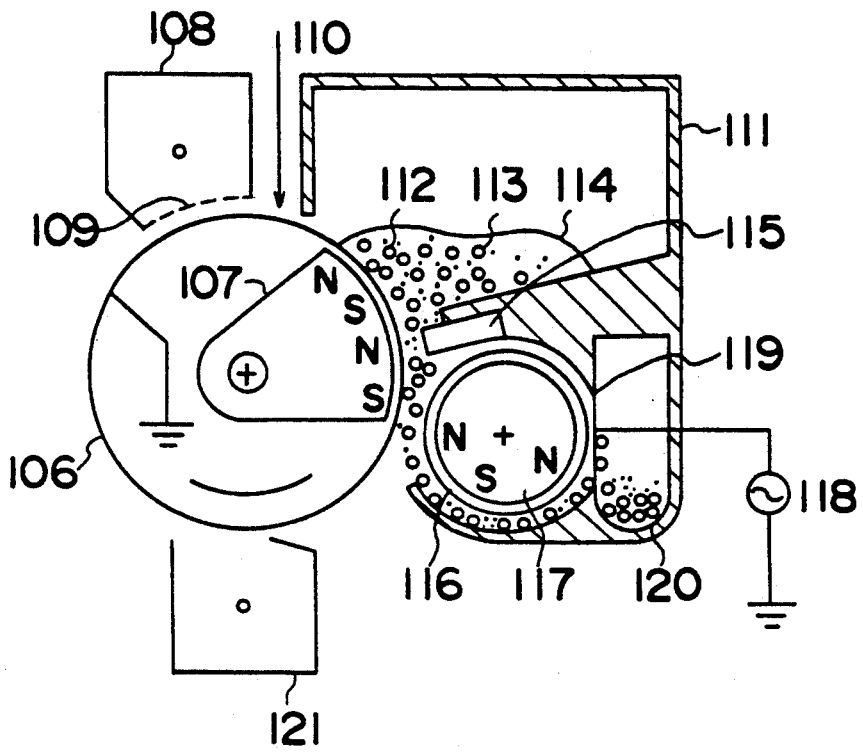
Figure 12:
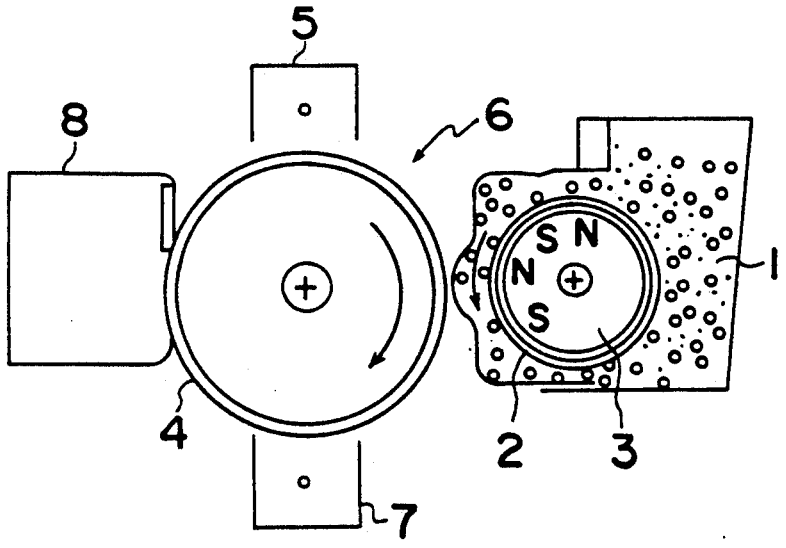
Fig. 12 Prior Art
FIG. 12 is a schematic side view of a prior art electrophotographic developing device.

Embodiment 10 (FIG. 11)

A tenth preferred embodiment of the present invention will now be described with particular reference to FIG. 11.

In FIG. 11, reference numeral 106 represents a photoreceptor drum having its outer peripheral surface formed with an organic photosensitive layer formed by dispersing azo dye into a binder resin. Reference numeral 107 represents a four-pole magnet disposed inside the photoreceptor drum 106 and fixedly mounted coaxially on a support shaft for the support of the photoreceptor drum 107. Reference numeral 108 represents a corona charger for charging the photosensitive layer of the photoreceptor drum 106 to a negative voltage. Reference numeral 109 represents a grid electrode for controlling the potential charged on the photosensitive layer on the photoreceptor drum 106 reference numeral 110 represents an imagewise light signal reference numeral 111 represents a developer hopper accommodating therein a mass of two component developing material 112 comprising silicone-coated iron carrier particles 113 of 100 μm in average particle size and toner particles 114 colored with carbon black. Reference numeral 115 represents a height regulating plate made of stainless steel and spaced a distance of 1 mm from the photosensitive layer on the photoreceptor drum 106; reference numeral 116 represents a recovery electrode roll made of aluminum and spaced a distance of 1 mm from the photosensitive surface on the photoreceptor drum 106. Reference numeral 117 represents a three-pole magnet fixedly mounted coaxially on a support shaft for the support of the recovery electrode roll 116. Reference numeral 118 represents an alternating current voltage source from which a voltage is applied to the recovery electrode roll. Reference numeral 119 represents a scraper in the form of a polyester film for scraping the developing material off of the recovery electrode roll 116. Reference numeral 120 represents a drain through which the used developing material can be discharged, and reference numeral 121 represents a transfer corona charger for transferring a visible toner image from the photosensitive layer onto a recording paper.

The magnetic flux density at the photosensitive layer on the photoreceptor drum 106, and also at an outer peripheral surface of the recovery electrode roll 116, is 800 Gs. The photoreceptor drum 106 including the photosensitive layer has an outer diameter of 30 mm and was driven at a peripheral speed of 30 mm/sec.

The photosensitive layer on the photoreceptor drum 106 was charged by the corona charger 108 to −500 volts by the application of a voltage of −4 kV to the corona charger 95 and a voltage of −500 volts to the grid electrode 109. Subsequently, the imagewise light signal 110 originating from a laser source and reflected from an image to be copied was projected onto the charged photosensitive layer to form the electrostatic latent image. The two-component toner material 112 containing the toner material in a concentration of 10% was subsequently magnetically deposited on the photosensitive layer within the developer hopper 111 and, as it passed by the height regulating plate 115, a toner layer of about 1.2 mm in thickness was formed on the photosensitive layer on the photoreceptor drum 106.

During the continued rotation of the photoreceptor drum 106, the toner layer on the photosensitive layer was allowed to pass in front of the recovery electrode roll 116. At this time, the recovery electrode roll 116 was applied from the high voltage power source 118 with an alternating current voltage of 700 VO-p of 1 kHz in frequency which was superimposed with a direct current voltage of −450 volts. As a result, the toner material forming the toner layer on the photosensitive layer underwent a reciprocating motion between the photosensitive layer and the recovery electrode roll 116, eventually leaving the toner material deposited on the electrostatic latent image on the photosensitive layer to form a visible toner image, while the residue toner material was transferred onto the recovery electrode roll 116. The toner material transferred onto the recovery electrode roll 116 was retained thereon by the magnetism of the magnet 117 disposed inside the recovery electrode roll 116 and was then conveyed during the rotation thereof towards a position where it was subsequently scraped by the scraper 119 off of the photoreceptor drum 106 and was collected in the drain 120 for discharge to the outside of the apparatus.

The visible toner image formed on the photosensitive layer on the photoreceptor drum 106 in the manner described above was then transferred by the transfer charger 121 onto a recording paper (not shown), which was subsequently transported through a fixing unit (not shown) to permanently fix the powder image on the recording paper in any known manner. After the transfer of the powder image onto the recording paper, the photosensitive layer on the photoreceptor drum 106 was again electrostatically charged by the corona charger 108 in readiness for the next succeeding formation of an electrostatic latent image by exposure to the imagewise light signal 110. As a result, sharp images with no toner scattering could be obtained.

Although the present invention has been described in connection with the various preferred embodiments thereof with reference to the accompanying drawings, it is to be noted that those skilled in the art can conceive numerous changes and modifications without departing from the scope of the present invention as defined by the appended claims. Such changes and modifications are to be construed as included within the scope of the present invention unless they depart therefrom.

What is claimed is:

1. An electrophotographic method comprising the steps of:

providing an electrostatic latent image carrier supported for movement in one direction and having a stationary magnet enclosed therein, an electrode roll spaced from the latent image carrier with a gap defined between the electrode roll and the latent image carrier, and a mass of magnetic one component developer;

forming an electrostatic latent image on a surface of the latent image carrier;

magnetically depositing the magnetic one component developer on the surface of the latent image carrier by said stationary magnet; and causing the electrode roll to remove the one component developer which has been deposited on a non-image area of the surface of the latent image carrier while allowing the one component developer to remain as deposited on the image area by applying an alternating current voltage to said electrode roll.

2. An electrophotographic method comprising the steps of:

providing an electrostatic latent image carrier supported for movement in one direction and having a stationary magnet enclosed therein, a developer reservoir containing a mass of magnetic developing material therein, a developer collecting electrode roll spaced from the latent image carrier with a gap defined between the electrode roll and the latent image carrier, and a height regulating plate;

forming an electrostatic latent image on a surface of the latent image carrier;

positioning the surface of the latent image carrier within the developer reservoir;

depositing the developing material on the surface of the latent image carrier so as to cause the developing material to be magnetically attracted onto the surface of the latent image carrier by said stationary magnet;

moving the latent image carrier so as to pass beneath the height regulating plate to level the developing material on the image carrier, forming a developer layer of substantially uniform thickness smaller than the gap between the latent image carrier and the electrode roll; and causing the developer layer to confront the electrode roll to remove the developing material deposited on a non-image area of the surface of the latent image carrier while allowing the developing material to remain as deposited on the image area by applying an alternating current voltage to said electrode roll.

3. An electrophotographic method which comprises the steps of:

providing an electrostatic latent image carrier supported for movement in one direction and having a stationary magnet enclosed therein, a developer reservoir containing a mass of magnetic developing material therein, a developer collecting electrode roll spaced from the latent image carrier with a gap defined between the electrode roll and the latent image carrier, and a height regulating plate;

forming an electrostatic latent image on a surface of the latent image carrier;

positioning the surface of the latent image carrier within the developer reservoir;

depositing the developing material on a surface of the latent image carrier so as to cause the developing material to be magnetically attracted onto the surface of the latent image carrier by said stationary magnet;

moving the latent image carrier so as to pass beneath the height regulating plate to level the developing material on the image carrier, forming a developer layer of substantially uniform thickness greater than the gap between the latent image carrier and the electrode roll; and causing the developer layer to confront the electrode roll to remove the developing material which has been deposited on a non-image area of the surface of the latent image carrier while allowing the developing material to remain as deposited on the image area by applying an alternating current voltage to said electrode roll.

4. An electrophotographic apparatus, which comprises:

an electrostatic latent image carrier supported for movement in one direction and having a stationary magnet enclosed therein;

a mass of magnetic one component developer adjacent said electrostatic latent image carrier; and means for removing developing material which has been deposited on a non-image area of the surface of said latent image carrier while allowing developing material to remain as deposited on an image area of the surface of said latent image carrier, said means comprising an electrode roll spaced from said latent image carrier with a gap defined between said electrode roll and said latent image carrier and a high voltage alternating electric current power source connected to said electrode roll.

5. An electrophotographic apparatus, which comprises:

an electrostatic latent image carrier supported for movement in one direction and having a stationary magnet enclosed therein;

means for forming an electrostatic latent image on said latent image carrier;

a developer reservoir positioned adjacent said latent image carrier and containing a mass of magnetic developing material therein, said developer reservoir allowing the developing material to be magnetically deposited on a surface of said latent image carrier by said stationary magnet;

a height regulating means for levelling developing material deposited on said image carrier while forming a developer layer of a substantially uniform thickness; and means for removing developing material which has been deposited on a non-image area of the surface of said latent image carrier while allowing developing material to remain as deposited on an image area of the surface of said latent image carrier, said means comprising a developer collecting electrode roll positioned downstream of said height regulating means with respect to the direction of movement of said latent image carrier, said electrode roll being spaced from said latent image carrier with a gap defined therebetween.

6. The apparatus as claimed in claim 5, wherein said height regulating means is an elastic member.

7. The apparatus as claimed in claim 5, wherein said height regulating means is a magnetic member positioned at a location aligned with a pole of said stationary magnet within said latent image carrier.

8. The apparatus as claimed in claim 5, wherein said height regulating means is an electroconductive member having a direct current voltage of a potential generally equal to the surface potential of said latent image carrier applied thereto.

9. The apparatus as claimed in claim 8, wherein said means for forming an electrostatic latent image on said latent image carrier comprises a scorotron charger having a grid electrode, and wherein a direct current voltage applied to said grid electrode and the direct current voltage applied to said height regulating means is of the same potential.

10. The apparatus as claimed in claim 5, and further comprising a scraper supported in a position so as to contact said electrode roll for recovering and returning developing material removed by said electrode roll back to said developer reservoir.

11. An electrophotographic apparatus, comprising:

an electrostatic latent image carrier supported for movement in one direction and having a stationary magnet enclosed therein;

means for forming an electrostatic latent image on said latent image carrier;

a developer reservoir positioned adjacent said latent image carrier and containing a mass of magnetic developing material therein, said developer reservoir being operable to allow the developing material to be magnetically deposited on a surface of said latent image carrier by said stationary magnet;

a height regulating means for levelling developing material deposited on said image carrier while forming a developer layer of a substantially uniform thickness;

means for removing developing material which has been deposited on a non-image area of the surface of said latent image carrier while allowing developing material to remain as deposited on an image area of the surface of said latent image carrier, said means comprising a rotatably supported developer collecting electrode roll positioned downstream of said height regulating means with respect to the direction of movement of said latent image carrier, said electrode roll being spaced from said latent image carrier with a gap defined therebetween and said electrode roll including a stationary magnet enclosed therein, and a high voltage power source for applying an alternating current voltage to said electrode roll.

12. The apparatus as claimed in claim 11, wherein said electrode roll rotates in the same direction as said latent image carrier.

13. The apparatus as claimed in claim 11, wherein said electrode roll rotates in the same direction and speed as said latent image carrier.

* * * * *